US006584678B2

(12) United States Patent
Burgess et al.

(10) Patent No.: US 6,584,678 B2
(45) Date of Patent: Jul. 1, 2003

(54) PRESSURE ACTUATED SWITCHING DEVICE AND TRANSFER METHOD FOR MAKING SAME

(76) Inventors: Lester E. Burgess, Box 522, Swarthmore, PA (US) 19081; Richard Lerch, 23 War Admiral La., Media, PA (US) 19063

( * ) Notice: Subject to any disclaimer, the term of this patent is extended or adjusted under 35 U.S.C. 154(b) by 7 days.

(21) Appl. No.: 09/836,638

(22) Filed: Apr. 17, 2001

(65) Prior Publication Data

US 2002/0178574 A1 Dec. 5, 2002

(51) Int. Cl.[7] ..... H01H 11/00

(52) U.S. Cl. ..... 29/622; 29/831; 29/846; 200/86 R; 200/61.43; 427/305

(58) Field of Search ..... 29/831, 846, 622; 200/86 A, 86 R, 61.43, 61.71; 427/305, 306, 307, 96

(56) References Cited

U.S. PATENT DOCUMENTS

| | | | | |
|---|---|---|---|---|
| 1,783,606 A | | 12/1930 | Dreyfus | 8/467 |
| 2,138,549 A | | 11/1938 | La Bell | 200/86 R |
| 2,238,479 A | | 4/1941 | Senseney | 118/211 |
| 2,843,694 A | | 7/1958 | Bertaux | 200/86 R |
| 3,165,606 A | | 1/1965 | Cooper | 200/86 R |
| 3,277,256 A | | 10/1966 | Jones | 200/61.43 |
| 3,321,592 A | | 5/1967 | Miller | 200/61.43 |
| 3,330,698 A | | 7/1967 | Podolsky | 427/526 |
| 3,561,493 A | | 2/1971 | Maillard | 138/141 |
| 3,710,054 A | | 1/1973 | Koenig | 200/86 R |
| 3,818,162 A | | 6/1974 | Monroe et al. | 200/86 R |
| 3,849,614 A | | 11/1974 | Connery | 200/61.41 |
| 4,060,705 A | | 11/1977 | Peachey | 200/86 R |
| 4,137,116 A | * | 1/1979 | Miller | 156/269 |
| 4,273,974 A | | 6/1981 | Miller | 200/61.43 |
| 4,293,752 A | | 10/1981 | Koenig | 200/295 |
| 4,301,621 A | | 11/1981 | Houweling | 49/27 |
| 4,369,344 A | | 1/1983 | Diamond | 200/61.43 |
| 4,374,898 A | | 2/1983 | Mahr | 428/447 |
| 4,396,814 A | | 8/1983 | Miller | 200/61.43 |
| 4,421,958 A | | 12/1983 | Kameda | 200/5 A |
| 4,532,388 A | | 7/1985 | Sackmann et al. | 200/61.43 |
| 4,617,433 A | | 10/1986 | Hoshikawa et al. | 200/86 R |
| 4,742,196 A | | 5/1988 | Kelly | 200/86 R |
| 4,762,970 A | | 8/1988 | Brinsley | 200/86 R |
| 5,023,411 A | | 6/1991 | Miller et al. | 200/61.43 |
| 5,072,080 A | | 12/1991 | Beckhausen | 200/61.43 |
| 5,101,549 A | * | 4/1992 | Sogge et al. | 200/83 N |
| 5,118,910 A | | 6/1992 | Duhon et al. | 200/86 R |
| 5,211,803 A | | 5/1993 | Johnson et al. | 156/625 |
| 5,310,970 A | * | 5/1994 | Kaigler et al. | 200/83 R |
| 5,728,983 A | | 3/1998 | Ishihara et al. | 200/61.43 |
| 5,780,793 A | | 7/1998 | Buchholz et al. | 200/61.44 |
| 5,834,719 A | | 11/1998 | Kaji et al. | 200/61.44 |
| 5,871,088 A | * | 2/1999 | Tanabe | 200/314 |
| 5,891,373 A | | 4/1999 | Hunter | 264/104 |
| 5,945,914 A | * | 8/1999 | Holmes et al. | 200/85 A |
| 6,064,014 A | * | 5/2000 | McCluskey et al. | 200/81.4 |
| 6,078,014 A | | 6/2000 | Kashiwazaki et al. | 200/61.43 |
| 6,107,580 A | | 8/2000 | Hoshikawa et al. | 200/61.43 |

FOREIGN PATENT DOCUMENTS

| | | |
|---|---|---|
| DE | G 92 13 726.1 | 2/1993 |

* cited by examiner

*Primary Examiner*—Timothy V. Eley
*Assistant Examiner*—Alvin J Grant
(74) *Attorney, Agent, or Firm*—Dilworth & Barrese, LLP

(57) ABSTRACT

A method for making a pressure actuated switching device includes applying a conductive coating to the release surface of a transfer substrate to form a conductive electrode film. The conductive film is brought into contact with a surface of a first substrate under conditions of heat and pressure sufficient to cause the conductive film to transfer from the release surface of the transfer substrate to the first surface of the first substrate. The first substrate is then positioned in juxtaposition with a second substrate having a conductive layer film of the first substrate. Also provided herein is a method for spring loading a terminal plug to the pressure actuated switching device.

40 Claims, 14 Drawing Sheets

PRESSURE ACTUATED SWITCHING DEVICE AND TRANSFER METHOD FOR MAKING SAME

BACKGROUND

1. Field of the Disclosure

The present invention relates to pressure actuated switching devices and a method for making them.

2. Description of the Related Art

Pressure actuated switching devices are known in the art. Typically, such devices include two spaced apart conductive layers enveloped in an insulative outer cover. Optionally, the conductive layers may be separated by an insulative spacer element, or "standoff." Also, the pressure actuated switching device can optionally include a piezoresistive material. The electrical resistance of a piezoresistive material decreases in relation to the amount of pressure applied to it. Piezoresistive materials provide the pressure actuated switching device with an analog function which not only detects the presence of a threshold amount of applied force but also provides a measure of its magnitude. Pressure actuated switching devices can be used as mat switches, drape sensors, safety sensing edges for motorized doors, and the like.

U.S. Pat. Nos. 6,121,869 and 6,114,645 to Burgess disclose a pressure activated switching device which includes an electrically insulative standoff positioned between two conductive layers. The standoff is preferably a polymeric or rubber foam configured in the form of contoured shapes having interdigitated lateral projections. Optionally the switching device can include a piezoresistive material positioned between a conductive layer and the standoff.

U.S. Pat. No. 5,856,644 to Burgess discloses a freely hanging drape sensor which can distinguish between weak and strong activation of the sensor. The drape sensor includes a piezoresistive cellular material and a standoff layer. The drape sensor can be used in conjunction with moving objects such as motorized doors to provide a safety sensing edge for the door. Alternatively, the drape sensor can be used as a freely hanging curtain to detect objects moving into contact therewith.

U.S. Pat. Nos. 5,695,859, 5,886,615, 5,910,355, 5,962,118 and 6,072,130, all to Burgess, disclose various embodiments of pressure activated switching devices.

As demand grows for lower cost high performance pressure actuated switching devices it becomes increasingly advantageous to have more efficient and more flexible methods of production. For example, it may be preferable to have one or more components fabricated more efficiently at one facility or operation, then shipped to another facility or operation for further processing and/or assembly. These and other advantages are provided by the method for making a pressure actuated switching device described below.

SUMMARY

A method is provided herein for making a pressure actuated switching device. The method comprises the steps of: (a) providing a first substrate having a first surface; (b) providing a transfer substrate having a release surface; (c) applying a conductive coating to the release surface of the transfer substrate; (d) contacting the conductive coating with the first surface of the first substrate under conditions of heat and pressure sufficient to cause the conductive coating to transfer from the release surface of the transfer sheet to the first surface of the first substrate; and (e) positioning the first substrate in juxtaposition with a second substrate.

BRIEF DESCRIPTION OF THE DRAWINGS

Various embodiments are described below with reference to the drawings wherein.

DETAILED DESCRIPTION OF PREFERRED EMBODIMENT(S)

Figure 1:
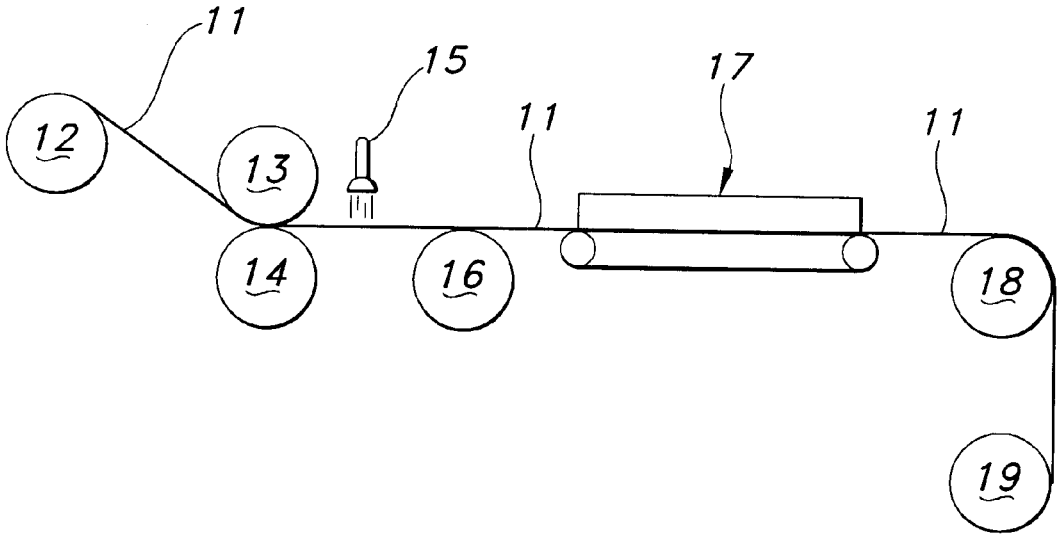
FIG. 1 is a diagrammatic illustration of a method and apparatus for making a transfer substrate.

As used herein the terms "conductive", "resistance", "insulative" and their related forms, pertain to the electrical properties of the materials described, unless indicated otherwise. The terms "top", "bottom", "upper", "lower" and like terms are used relative to each other. The terms "elastomer" and "elastomeric" are used herein to refer to a material that can undergo at least about 10% deformation elastically. Typically, elastomeric materials suitable for the purposes described herein include polymeric materials such as plasticized polyvinyl chloride, thermoplastic polyurethane, and natural and synthetic rubbers and the like. As used herein, the term "piezoresistive" refers to a material having an electrical resistance which decreases in response to compression caused by mechanical pressure applied thereto in the direction of the current path. Such piezoresistive materials typically include resilient cellular polymers foams with conductive coatings covering the walls of the cells. Composition percentages are by weight unless specified otherwise. Except for the claims all quantities are modified by the term "about".

"Resistance" refers to the opposition of the material to the flow of electric current along the current path and is measured in ohms. Resistance increases in proportion to the length of the current path and the specific resistance, or "resistivity", of the material, and it varies inversely to the amount of cross-sectional area available the current path. The resistivity is a property of the material and may be thought of as a measure of (resistance/length)×area. More particularly, the resistance may be determined in accordance with the following formula:

$$R=(\rho L)/A \quad \text{(I)}$$

wherein

R=resistance in ohms

ρ=resistivity in ohm-inches

L=length in inches

A=area in square inches.

The current through a circuit varies in proportion to the applied voltage and inversely with the resistance as provided by Ohm's Law:

$$I=V/R \quad \text{(II)}$$

wherein

I=current in amperes

V=voltage in volts

R=resistance in ohms.

Typically, the resistance of a flat conductive sheet across the plane of the sheet, i.e., from one edge to the opposite edge, is measured in units of ohms per square. For any given thickness of the conductive sheet, the resistance value across the square remains the same no matter what the size of the square is. In applications where the current path is from one surface to another, i.e., in a direction perpendicular to the plane of the sheet, resistance is measured in ohms.

In one step of the method of the present invention a substrate is provided which has an interior surface and an exterior surface. The exterior surface is that which, upon assembly of the pressure actuated switch, faces outward. The interior surface is that which, upon assembly of the pressure actuated switching device, faces the interior. Two substrates are provided: a lower substrate serves as a base, the upper substrate serves as a cover. In the event that the pressure actuated switching device is used, for example, as a floor mat switch, the exterior surface of the base faces downward and is in contact with the floor. The exterior surface of the cover faces upward. The two substrates are internally spaced apart with a standoff or other spacing means and are sealed together around their peripheries with a bonding edge spacer to enclose an interior space. The interior surfaces of the cover and base are in opposing relation and have electrically conductive layers to serve as electrodes. An electrically insulative spacer element disposed between the cover and base substrates can optionally be used to separate the electrodes. Optionally, the pressure actuated switching device can include a piezoresistive material. U.S. Pat. No. 5,695,859, which is herein incorporated by reference, discloses several embodiments of pressure actuated switching devices.

The substrates herein can be of the same or different material and are fabricated from any type of durable material capable of withstanding the stresses and pressures of environmental conditions. A preferred material for the substrates is a thermoplastic such as elastomeric or flexible polyvinyl chloride ("PVC") sheet. The upper and lower substrates can be heat sealed around the edges to form a peripheral hermetic seal. The sheets can be of any suitable thickness. Preferably, each sheet has a thickness ranging from about 1/64 inches to about ½ inches, more preferably from about 1/32 inches to about ¼ inches, although thicknesses outside of these ranges may also be used. The sheets may be embossed or ribbed. The lower sheet can alternatively be rigid or resiliently flexible to accommodate various environments or applications. Preferably, the upper or cover sheet is an elastomeric plasticized PVC. Resilient PVC sheet can be fabricated from plastisol by methods known to those with skill in the art.

In another step a transfer substrate is provided having a release surface. Such transfer substrates are known in the art and generally comprise a paper of suitable strength and dimension which has at least one side coated with a non-stick release agent such as silicone, polytetrafluoroethylene, or other non-stick type material to form a release surface. A transfer substrate suitable for the purposes described herein is available under the designation 30#S/1/S from Griff and Associates LP, 7900 No. Radcliffe St., Bristol, Pa. 19007. Alternatively, the transfer substrate can be a metal substrate and the release surface can be a chrome plated surface.

In another step of the method described herein a conductive coating is applied to the release surface of the transfer substrate sheet as illustrated in FIG. 1. The conductive coating, which serves as an electrode in the pressure actuated switching device, is preferably applied as a fluid and then dried. A preferred composition for the conductive coating material includes a binder such as a polymeric resin, a conductive filler such as a particulate metal (e.g., a fine powder or fibers of: copper, silver, gold, zinc, aluminum, nickel, silver coated copper, silver coated glass, silver coated aluminum), graphite powder, graphite fibers, or carbon (e.g., carbon black), and optionally a diluent or solvent. The solvent can include organic compounds, either individually or in combination, such as ketones (e.g., methylethyl ketone, diethyl ketone, acetone), ethers (e.g., tetrahydrofuran), esters, (e.g., butyl acetate), alcohols (e.g., isopropanol), hydrocarbons (e.g., naphtha, xylene, toluene), or any other liquid capable of dissolving the selected binder. Water can be used as a diluent for aqueous systems. An exemplary formulation for the conductive coating material is given below in Tables I and II:

TABLE I

Organic Solvent System
(Composition in parts by weight)

| | Broad Range | Preferred Range |
|---|---|---|
| Binder | | |
| Polyurethane thermoplastic elastomeric resin (28.9% solids in tetrahydrofuran) | 1–5 | 2–4 |
| Conductive Filler | | |
| Silver pigment | 5–9 | 6–8 |
| Solvent | | |
| Methylethyl ketone | 20–300 | 100 |

TABLE II

| Aqueous System (Composition in parts by weight) | | |
|---|---|---|
| | Broad Range | Preferred Range |
| Binder | | |
| Polyurethane thermoplastic elastomeric resin (40% solids in an aqueous emulsion or latex) | 2–10.7 | 4–8 |
| Conductive Filler | | |
| Silver pigment | 5–9 | 6–8 |
| Diluent | | |
| Deionized water (with surfactant) | 20–300 | 30–100 |

The formulation can be modified by selecting other component materials or composition amounts to accommodate different substrate materials or conditions of operation.

After deposition of the coating composition by casting, roller application, silk screening, rotogravure printing, knife coating, curtain coating, offset coating or other suitable method, the composition of Table I is transformed into a solid film by evaporating the solvent or other fluid, thereby leaving only the binder with conductive filler incorporated therein as a solid coating.

Referring now to FIG. 1 a transfer substrate, i.e., strip 11, is drawn off supply roll 12 and is passed between alignment rolls 13 and 14. A spray type or other type coating applicator 15 applies the fluid conductive coating composition to the release surface of the transfer strip 11. Carrier roll 16 directs the coated transfer strip 11 into a drying oven 17. Oven temperature conditions are such as to dry the conductive coating by evaporating the solvent to form a solid conductive film. The transfer strip 11 with the dried conductive film is conveyed from oven 17 by carrier 18 and then stored on winding roll 19 until used for later processing. Alternatively, as mentioned above, the conductive coating can be applied by silk screening, rotogravure printing, knife coating, curtain coating, offset coating or any other method suitable for applying coatings or inks.

The conductive coating composition can be applied to form a simple planar film or, alternatively, may be contoured into various planar shapes or patterns. The dried conductive film is elastomeric and serves as an electrode in the pressure actuated switching device and can have any suitable thickness. Preferably, the conductive coating has a thickness ranging from 0.1 mil to 60 mils (1 mil=0.001 inch), more preferably from 1 mil to 10 mils. The percentage of conductive filler in the dried conductive electrode film can preferably range from 50% to 95%, and imparts a conductivity to the conductive film preferably ranging from 0.001 to 500 ohms per square, more preferably from 0.1 to 10 ohms per square. In terms of specific resistance, the conductive electrode film can possess a resistivity about as low as that of metallic silver (i.e., about 1.59 microhm-cm), or higher depending on the type of conductive filler used and its composition percentage in the conductive electrode film.

In another step of the method described herein the conductive coating is contacted with the interior surface of one or both of the substrate sheets under conditions of heat and pressure sufficient to cause the conductive coating to transfer and adhere to the surface of the substrate.

Figure 2:
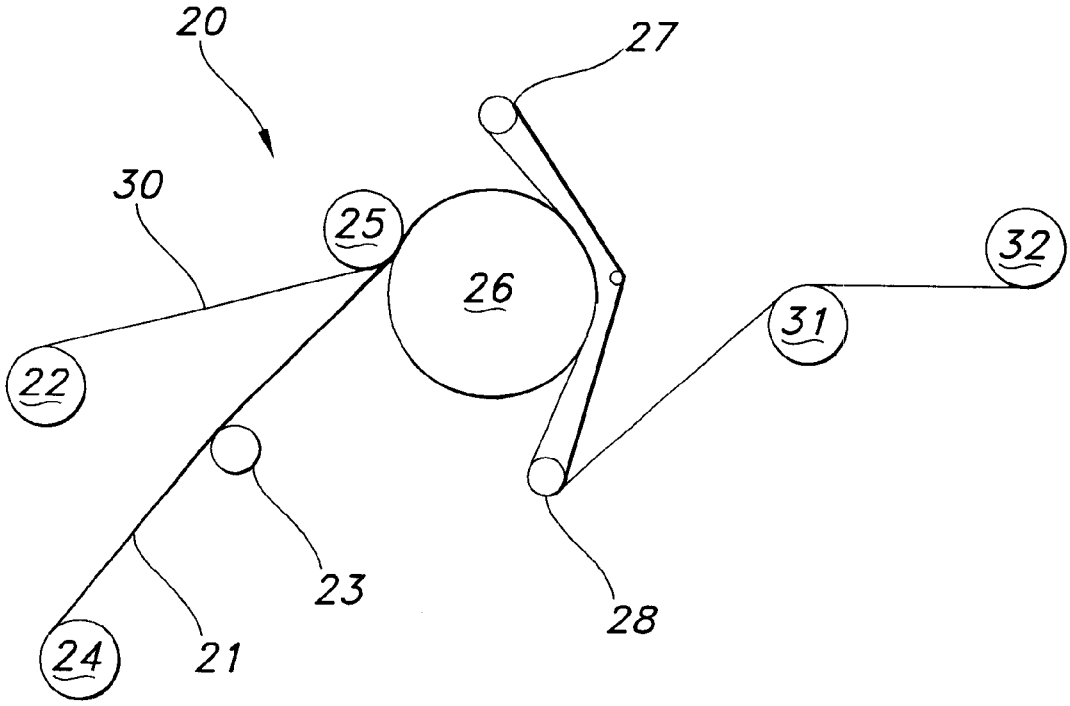
FIG. 2 is a diagrammatic illustration of a method and apparatus for transferring a conductive electrode film from a transfer strip to a substrate for use in a pressure actuated switching device.

Referring now to FIG. 2, an apparatus 20 is illustrated which exemplifies a method for contacting the conductive coating with a substrate. The electrode coated transfer substrate strip 21 is drawn off supply roll 24 such that the conductive electrode coated side on the release surface faces upward. Transfer strip 21 passes over idling roll 23 and is thereafter brought into contact with substrate sheet 30 drawn off substrate supply roll 22 such that the electrode coated release surface of the transfer strip is brought into contact with the interior surface of the substrate. The transfer strip 21 and substrate 30 are then passed between roller 25 and heated drum 26. Drum 26 heats the transfer strip 21 to a temperature of from 250° F. to 500° F. Rubber belt 29 circulates around rolls 27 and 28, and serves to apply pressure to the transfer strip 21 and substrate 30 to maintain the transfer strip 21 and substrate 30 in contact with substrate 30, compressing it against the electrode coated transfer strip 21 and the heated drum 26 for a period of time sufficient to cause the transfer of the conductive electrode coating from the weakly adherent release surface of the transfer strip 21 to the substrate 30. Substrate 30, still traveling with transfer strip 21, is then cooled and passed around roll 31. The substrate with the conductive coating and the blank transfer strip are then passed to wind-up reel 32 onto which they are preferably stored together, the blank transfer strip providing an abrasion shield for the conductive coating. The method herein advantageously permits the transfer substrate to be more efficiently fabricated at one facility or operation, then shipped to another facility or operation for further processing and/or assembly. Alternatively, the function of transfer strip 21 may be performed by a conveyer belt having a release surface on which the conductive coating is deposited, then dried to form the conductive film, the belt being returned to the coating applicator stage of the process after transfer of the conductive film to the substrate.

Figure 3:
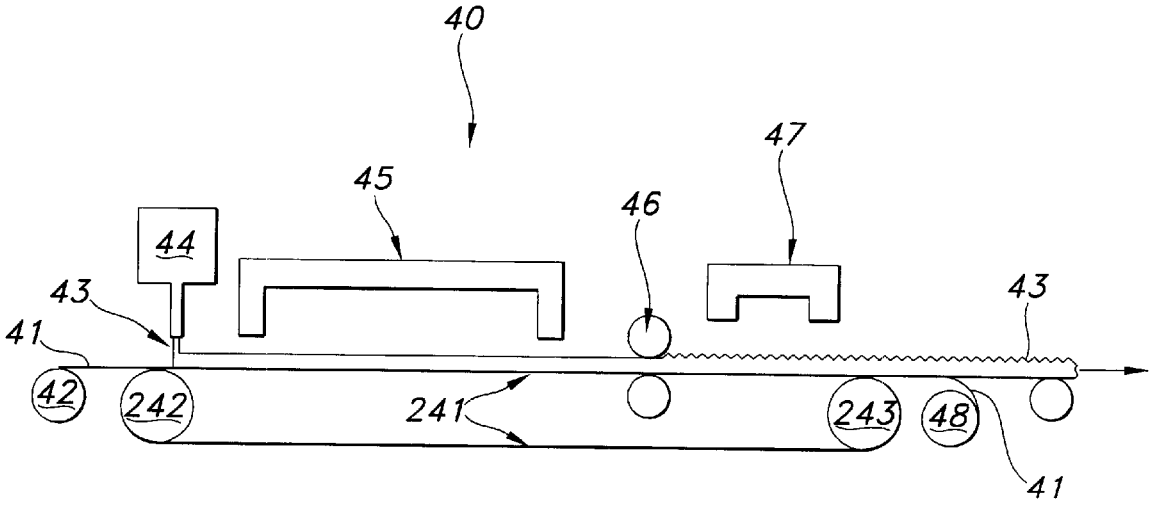
FIG. 3 is a diagrammatic illustration of a method and apparatus for transferring a conductive electrode film to a substrate during a casting and fusing process.

Referring now to FIG. 3, yet another method of contacting the conductive coating with the substrate is exemplified. Transfer substrate sheet 41 with an electrode conductive coating on the release surface facing upwards is drawn off a supply roll 42 onto a conveyor belt 241. A quantity of fluid plastisol 43 is meter deposited over the conductive coating from plastisol supply 44. The plastisol constitutes the substrate which will serve as the cover and/or base of the pressure actuated switching device.

Plastisol is initially a fluid compound which includes high molecular weight fine particles of PVC resin dispersed in a plasticizing liquid with stabilizers, lubricants, pigments and filler particulates. Upon the application of sufficient heat, plastisol fuses into a homogeneous solid resin system with a flexibility depending upon the amount of plasticizer fused into the resin system. As shown in FIG. 3, the cast plastisol 43 and transfer sheet 41 are conveyed by conveyor belt 241 through an oven 45 which heats the plastisol to a temperature of from 250° F. to 500° F. The plastisol then fuses into a sheet of resilient material. Roll 46 cools and embosses the solid sheet of plastisol 43 with ridges or other shaped projections on the side opposite that to which the conductive coating is contacted. The plastisol sheet 43 is then passed through a further chilling stage 47 (e.g., a water mister) where the plastisol sheet 43 is cooled to ambient temperature, retaining the definitive shape produced by the embossing roll. The transfer street 41, without the conductive film, is stripped from the underside of the fused PVC sheet and optionally can be separated and rolled onto roll 48. The supporting conveyor belt 241 travels around return roll 243 and returns to roll 242. The plastisol substrate 43 with the conductive electrode coating on one side and embossing on the opposite side is then sent on to further processing or storage.

Figure 4:
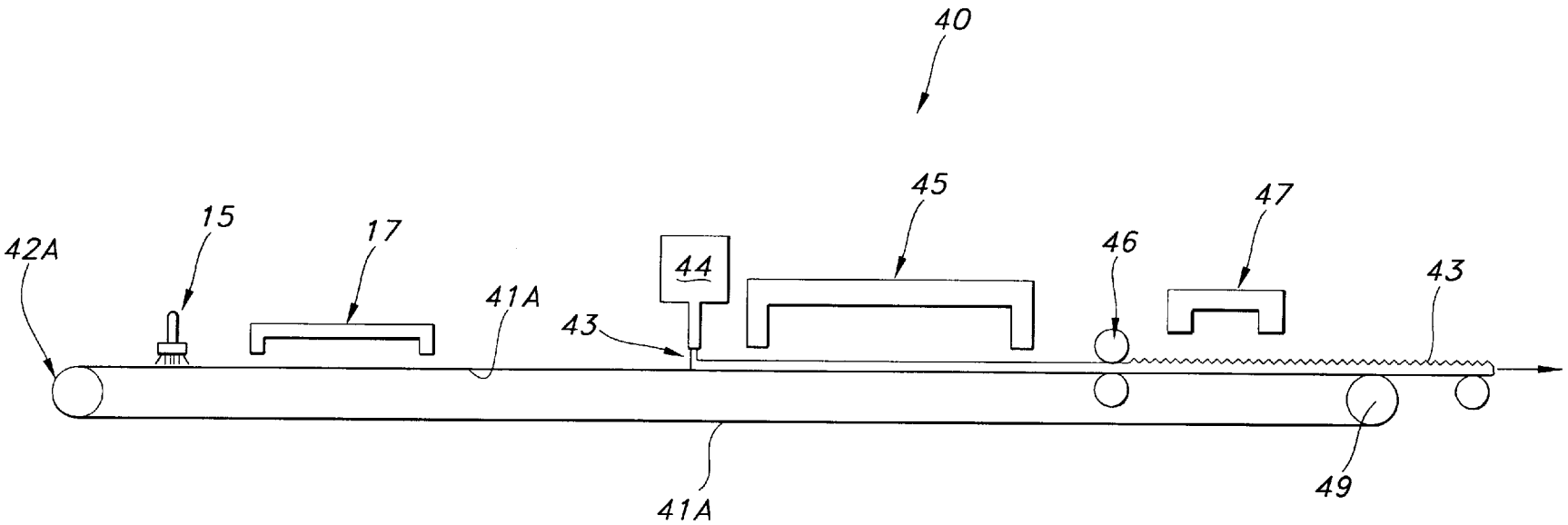
FIG. 4 is a diagrammatic view illustrating an alternative method and apparatus to that illustrated in FIG. 3.

Referring now to FIG. 4, an alternative to the use of a transfer sheet is the use of conveyor belt 41A which, after being passed around forward roll 42A, has an extended preplastisol casting zone in which conductive coating composition is applied directly to belt 41A by applicator 15 and dried in drying oven 17 to form a conductive electrode film. Conveyor belt 41A includes a fabric which has a release surface onto which the conductive coating composition and thereafter the plastisol are deposited. The operational steps after the application of plastisol 43 are similar to the steps illustrated in FIG. 3 except that a separate transfer sheet is not used.

Figure 5:
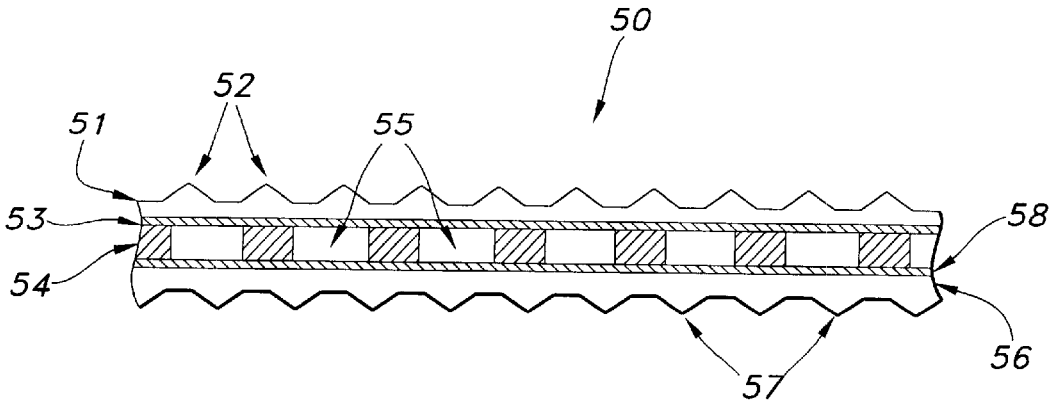
FIG. 5 is a sectional side view of a pressure actuated switching device.
Figure 5A:
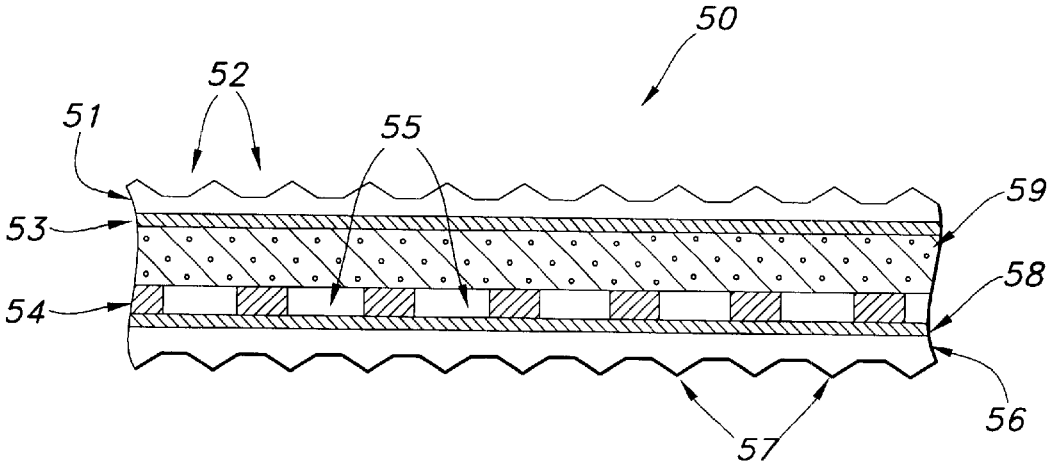
FIG. 5A is a sectional side view of the device of FIG. 5 further including a piezoresistive layer.

Referring now to FIG. 5, a pressure actuated switching device 50 is illustrated. Fused plastisol substrate 51 with conductive electrode coating 53 applied to the interior surface in accordance with the method described above with respect to FIG. 3, and optionally with embossed ridges 52 on the outer surface, is positioned at the top portion of the pressure actuated switching device. A similarly made plastisol substrate 56 having conductive layer 58 on the interior surface and optional embossed ridges 57 on the outside surface is positioned at the bottom portion of the pressure actuated switching device 50 such that the conductive coating 53 and conductive layer 58 are in opposing relation to each other. Optionally, conductive layer 58 can be a conductive coating formed and applied in the same manner as conductive coating 53. Alternatively, conductive layer 58 can be a metal sheet or foil. Optionally, a standoff 54 having openings 55 is disposed between the conductive coatings 58 and 53. The standoff can be fabricated from a relatively rigid solid material such as rigid plastic sheet, a flexible solid material such as neoprene, or a cellular elastomeric foam material, such as polyurethane foam. Optionally, as illustrated in FIG. 5A, a sheet of piezoresistive material 59 can be positioned between the standoff 54 and one or both of the conductive coatings 58 and 53. Piezoresistive materials are known in the art. Suitable piezoresistive materials are disclosed in U.S. Pat. No. 5,695,859. Conductive wire leads (not shown) are connected respectively to the conductive coatings which serve as electrodes within the pressure actuated switching device 50. The wire leads allow the pressure actuated switching device 50 to be incorporated into an electrical circuit for controlling the operation of machinery, alarms, etc. The substrates 51 and 56 are heat bonded together around their edges, or alternatively with a bondable edge spacer, to form an hermetic seal.

Figure 6:
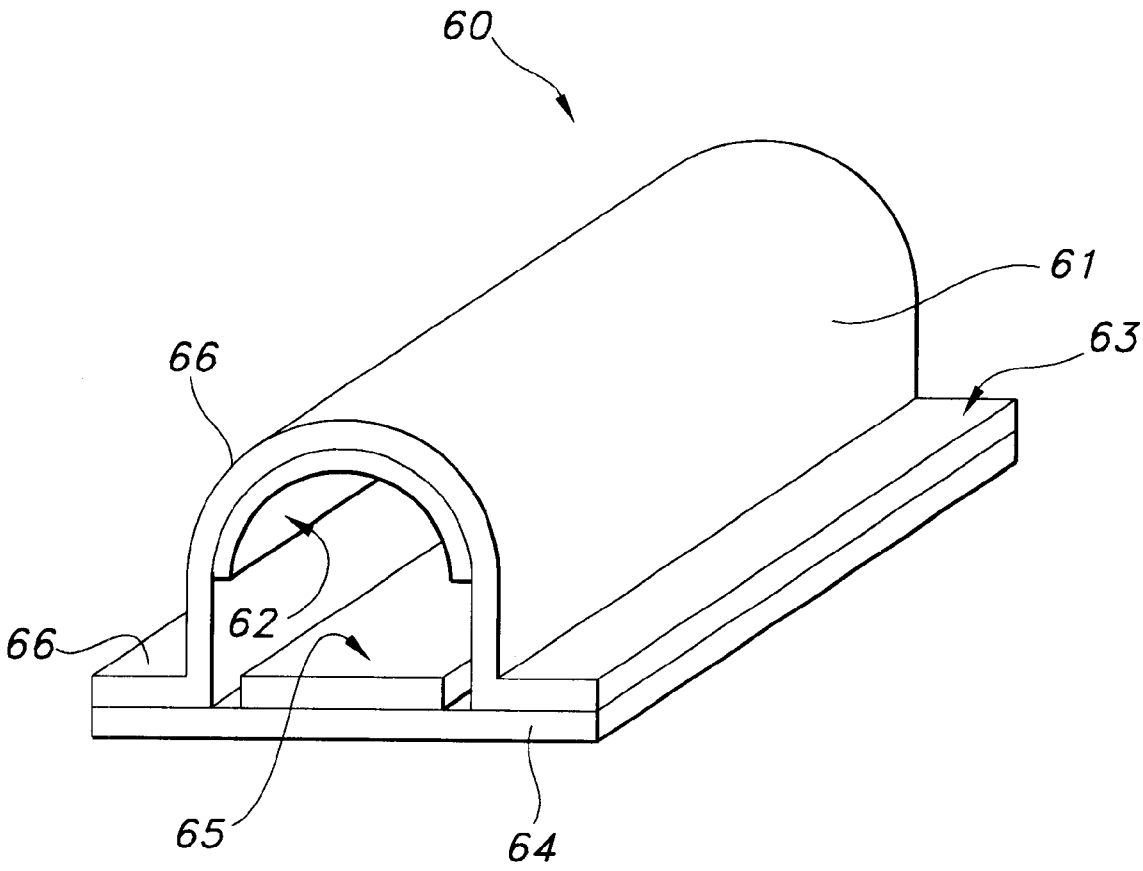
FIG. 6 is a perspective view of a another embodiment of a pressure actuated switching device.

Referring now to FIG. 6, an elongated pressure actuated switching device 60 is illustrated wherein the cover substrate 61 includes a curved upper portion 66 and a lateral flange portion 63 extending along each of two opposite sides. A conductive electrode coating 62 is deposited on the interior surface of the cover substrate at the curved upper portion 66. The base substrate 64 is an elongated flat member having a conductive electrode coating 65 applied to the upper surface. The cover substrate 61 and base substrate 64 are hermetically sealed along flange portion 63 by any suitable means such as adhesive bonding, heat seal bonding, etc. Cover substrate 61 is fabricated from a flexible and resilient material such that pressure applied to the top surface of the cover substrate 61 causes the cover substrate to resiliently deform so as to bring the upper conductive electrode coating 62 into contact with lower conductive electrode coating 65, thereby making electrical contact and closing the switch. Base substrate 64 can be mounted, for example, to a floor or to the edge of a movable door such as a garage door, rotating door, etc.

Figure 7:
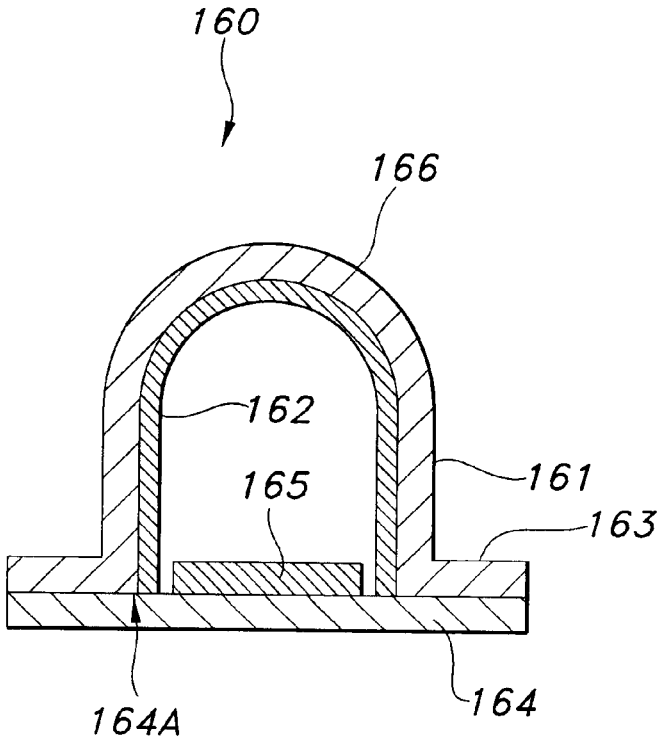
FIGS. 7 and 8 are sectional views illustrating an alternative embodiment of the pressure actuated switching device of FIG. 6 in unactuated and actuated conditions, respectively.
Figure 8:
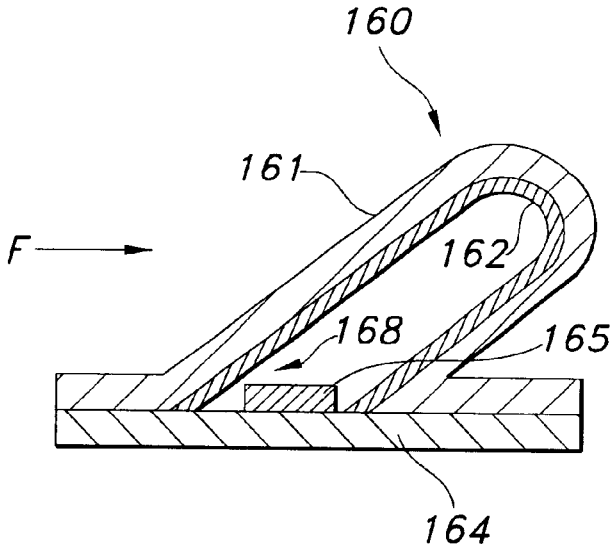

Referring to FIGS. 7 and 8, an alternative embodiment 160 of an elongate pressure actuated switching device is shown. Switching device 160 includes a cover substrate 161 having a curved upper portion 166 and a base substrate 164. The cover substrate 161 is fabricated from a resiliently flexible material and includes a conductive electrode film 162 along an interior surface, the conductive electrode film 162 extending to, or in the vicinity of, the insulating junction 164A between the base substrate 164 and the cover substrate 161. A conductive film 165 is deposited on the upper surface of base substrate 164 and is separated from conductive layer 162 by a gap. Upon application of a lateral side force F, the cover substrate 161 deforms to allow conductive film 162 to contact conductive film 165 and thereby make electrical contact for closing the switch. Accordingly, pressure actuated switch 160 is responsive not only to downwardly directed force but also to lateral force.

Figure 9:
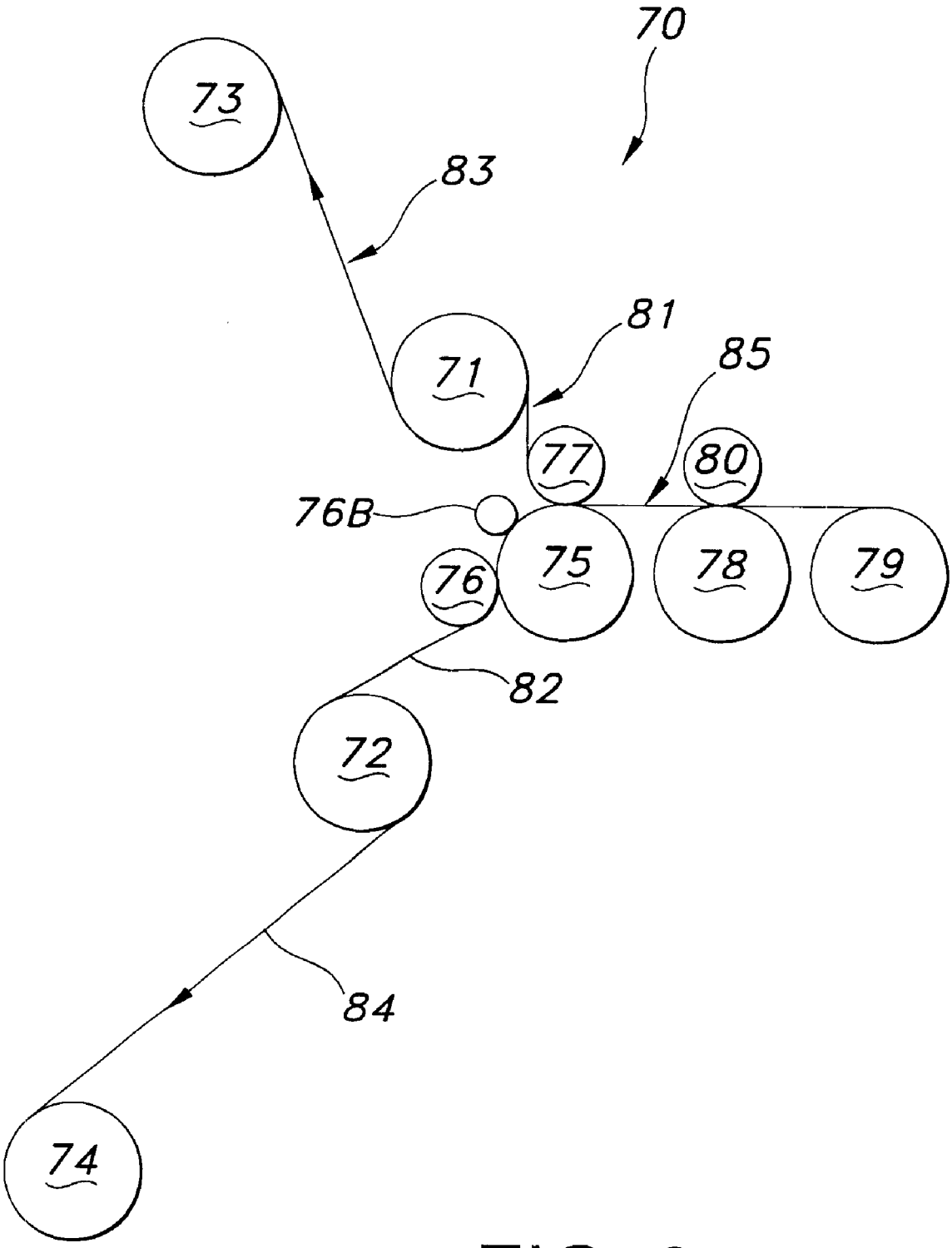
FIG. 9 is a diagrammatic illustration of an apparatus and method for making the pressure actuated switching device of FIG. 6.

FIG. 9 illustrates an apparatus and method for making the elongated pressure actuated switch 60 illustrated in FIG. 6 using an electrode coated substrate such as substrate 30 fabricated in accordance with the method and apparatus described above in connection with FIG. 2. The substrate can be of any dimensions suitable for the use described herein. Typically, the substrate can have a thickness ranging from about 1/64 inches to about 1/4 inches, although thicknesses outside of this range may also be used where appropriate.

Referring to FIG. 9, electrode coated substrate 81 is drawn off supply roll 71 with electrode coated side down. The associated blank transfer strip 83 is separated and stored on roller 73. A second substrate 82 is drawn off supply 72 with coated side up. The associated blank transfer strip 84 is separated and stored on roller 74. Substrate 82 is passed through cam roll 76, and tuck roll 75 which form the substrate 82 into a U-shaped configuration.

Figure 10:
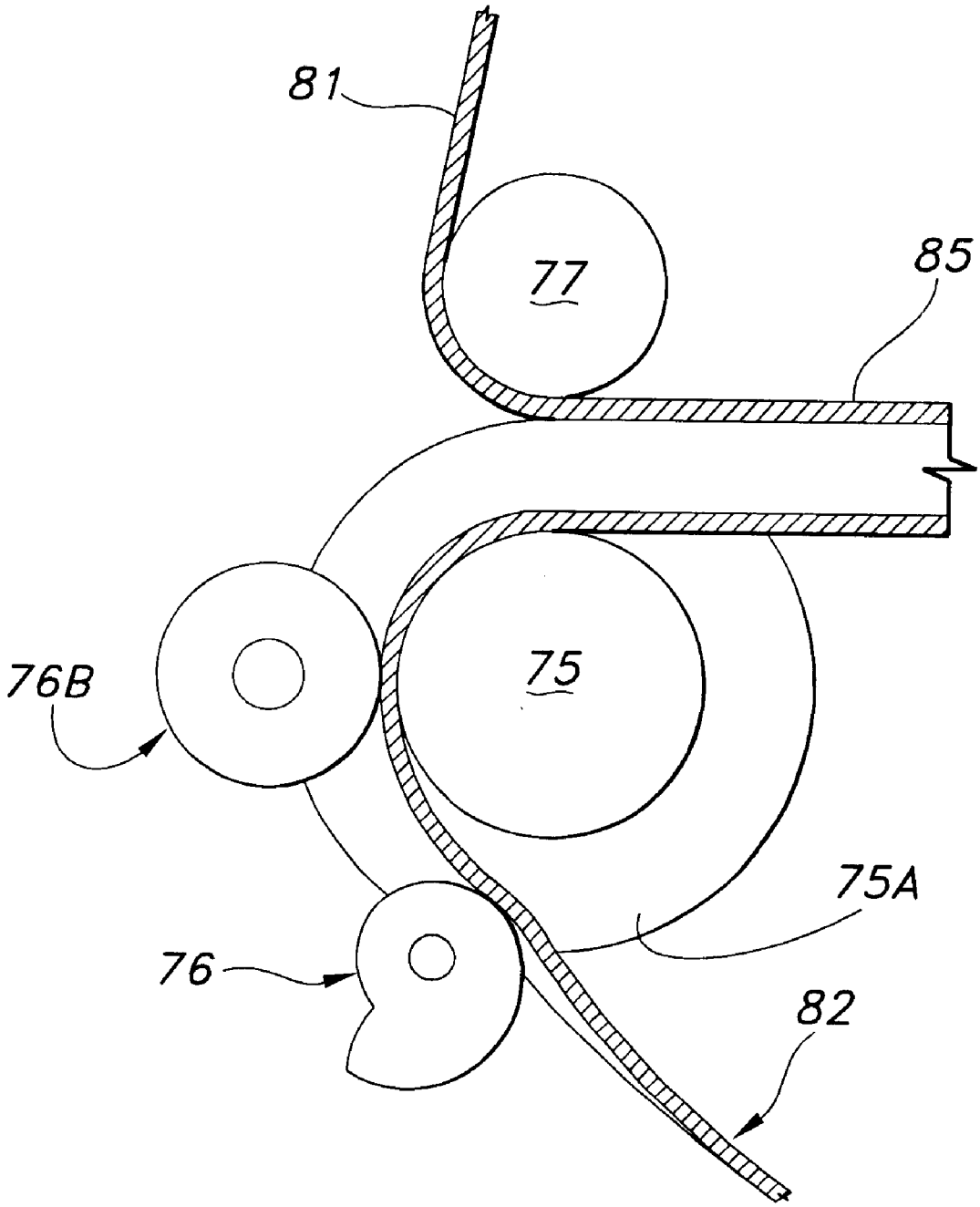
FIG. 10 is a diagrammatic view of nip and tuck rolls used in the apparatus of FIG. 9.
Figure 11:
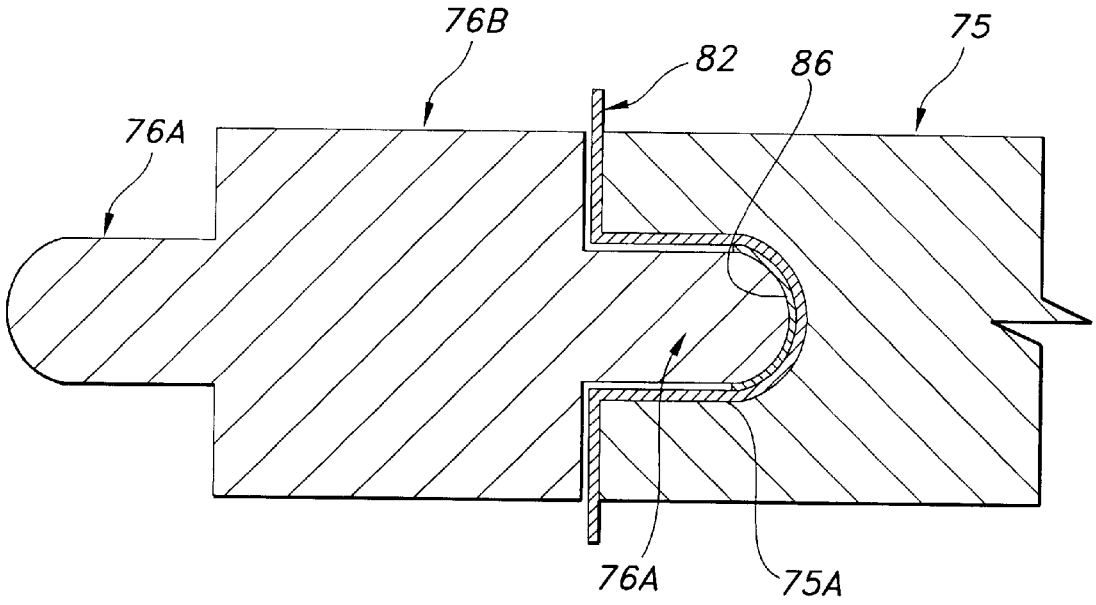
FIG. 11 is a sectional view of nip and tuck rollers used in the apparatus of FIG. 9.

More particularly, referring briefly now to FIGS. 9, 10 and 11, female tuck roller 75 includes a U-shaped recess 75A which extends circumferentially around the edge of the roll 75. Cam roll 76 includes a variably extending circumferential projection which progressively tucks substrate 82 into the U-shaped recess 75A of tuck roll 75 as the cam roll 76 turns. As shown in FIG. 11, male nip roller 76B includes a circumferential projection 76A adapted to engage recess 75A. The substrate 82 with conductive electrode coating 86 is passed between the nip and tuck rollers so as to be fully formed into a U-shaped configuration with flanges.

Referring again now to FIGS. 9 and 10, substrates 81 and 82 are joined to form elongated pressure actuated switch 85. Heat seal roll 77 bonds the lengthwise edges of the substrates to form an hermetic seal along each side of the pressure actuated switch 85. Cutting and trimming rollers 80 and 78 cut and trim the edges of the pressure actuated switch 85, which is thereafter stored on roll 79.

Figure 12:
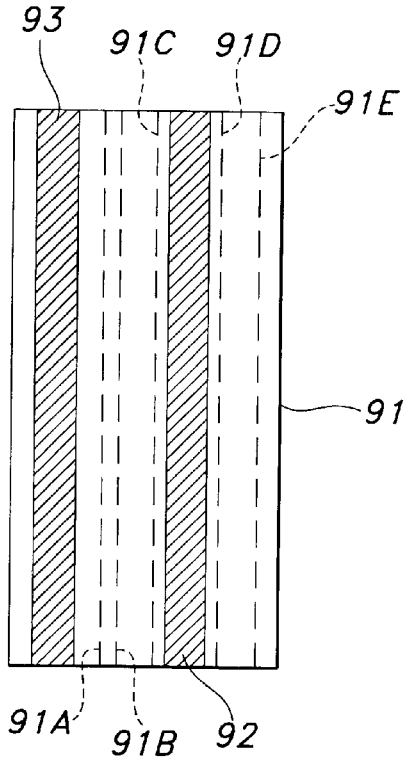
FIG. 12 is a plan view of a substrate sheet including conductive electrode coating strips.
Figure 13:
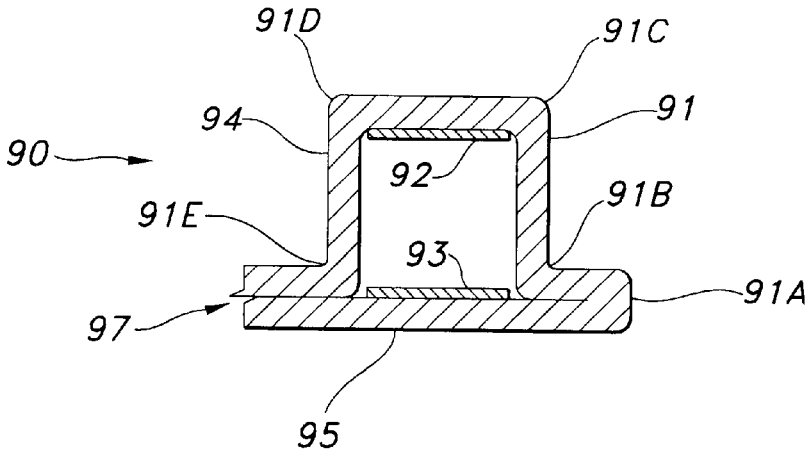
FIG. 13 is a sectional end view of a pressure actuated switching device made from the substrate sheet shown in FIG. 8.

Referring now to FIGS. 12 and 13, a pressure actuated switching device 90 is formed from a single sheet 91 of substrate material having parallel strips 92 and 93 of conductive electrode films deposited thereon in a lengthwise direction. Conductive strip 92 may be wider than illustrated in FIG. 13, i.e., conductive strip may be configured and dimensioned similar to conductive strip 192 of FIG. 14 which extends along the inside surface of the vertical sides of the pressure actuated switching device. The pressure actuated switching device is fabricated by forming a 180° degree bend along longitudinal fold line 91A, an upward bend at longitudinal fold line 91B, a lateral bend at longitudinal fold line 91C, a downward bend at longitudinal fold line 91D, and a lateral bend at fold line 91E. Bends 91B, 91C, 91D and 91E are preferably right angle bends, but other angles can also be used such that the cross section of the pressure actuated switching device can have a square configuration, rectangular configuration, trapezoidal configuration, etc. When folded as shown in FIG. 13, substrate sheet 91 includes a substrate cover portion 94 and a substrate base portion 95. The edges of substrate sheet 91 are bonded by adhesive, heat, or other suitable method to form an hermetically sealed seam 97 extending along the length of the pressure actuated switching device 90. Conductive electrode films 92 and 93 are applied to substrate sheet 91 in accordance with the coating formulation and methods described above. The coating thickness can range from 0.1 mils to about 60 mils as described above. The substrate sheet 91 can be any resiliently flexible polymeric material, preferably a thermoplastic plasticized polymer such as PVC.

Figure 14:
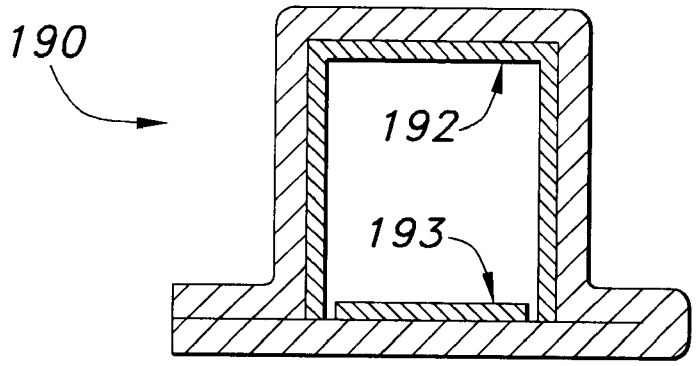
FIG. 14 is a sectional end view of an alternative embodiment of the pressure actuated switching device of FIG. 13.

Referring now to FIG. 14, the conductive top electrode film 192 can be applied such that it extends down the interior side surfaces of the substrate sheet 91 when folded to form pressure actuated switch 190. The switch 190 structure provides side actuation sensitivity in response to a laterally directed side force in addition to vertical sensitivity, as described above in connection with pressure actuated switch 160 as illustrated in FIGS. 7 and 8.

Figure 15:
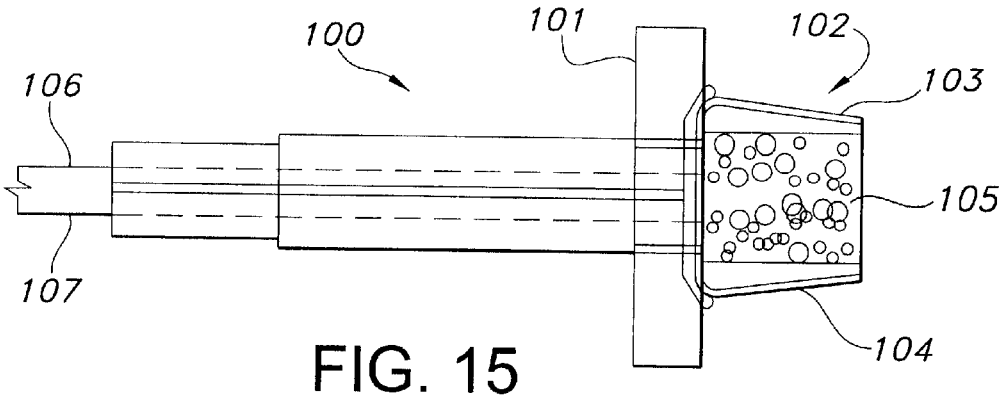
FIG. 15 is a diagrammatic illustration of a terminal plug for insertion into the end of the pressure actuated switching device of FIG. 9.
Figure 19:
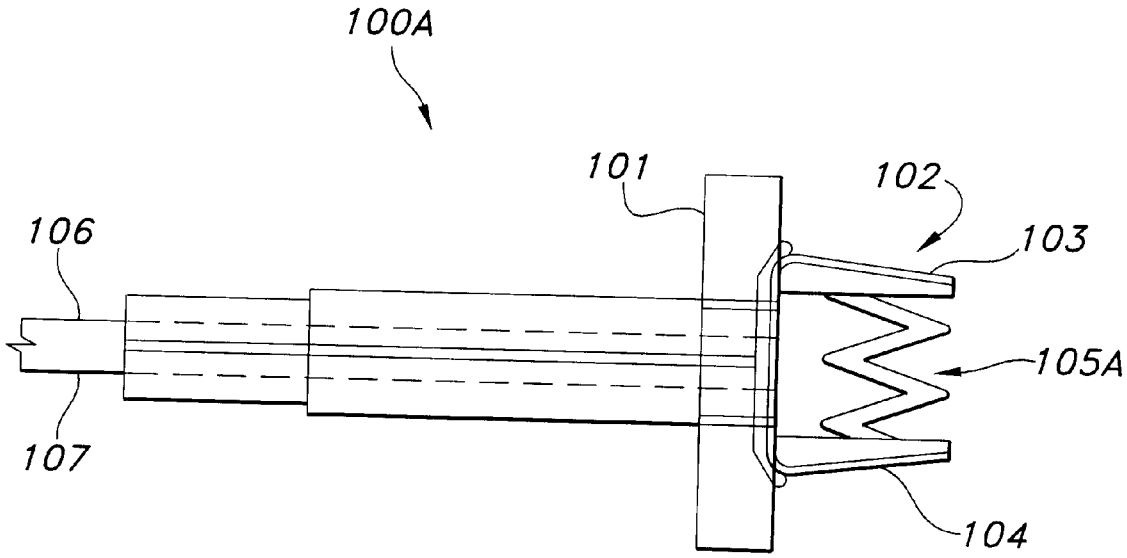
FIG. 19 is a diagrammatic illustration of an alternative embodiment of the terminal plug illustrated in FIG. 15.

Referring now to FIG. 15 a terminal plug 100 for electrically connecting pressure actuated switching device 90 to wire leads includes a body 101 adapted to engage and close an end of the pressure actuated switching device 90. A male connector 102 is adapted to spring load fit within the opening at the end of the pressure actuated switching device 90 and includes a resilient polymeric foam member 105 having upper and lower conductive metal foil contacts 103 and 104, respectively. Metal contacts 103 and 104 are preferably fabricated from metal foil or sheet (e.g. aluminum foil or sheet, copper foil or sheet, nickel foil or sheet, and the like). The upper and lower metal foil contacts 103 and 104 are connected to wires 106 and 107, respectively. When terminal plug 100 is fully inserted into the end of the pressure actuated switching device 90, foam member 105 resiliently biases metal foil contacts 103 and 104 in an outward direction to facilitate electrical connection with conductive electrode coatings 92 and 93 of pressure actuated switch 90. Alternatively, as shown in FIG. 19, terminal plug 100A can employ a metal spring 105A instead of, or in addition to, foam member 105 to outwardly bias the metal foil contacts 103 and 104.

Figure 16:
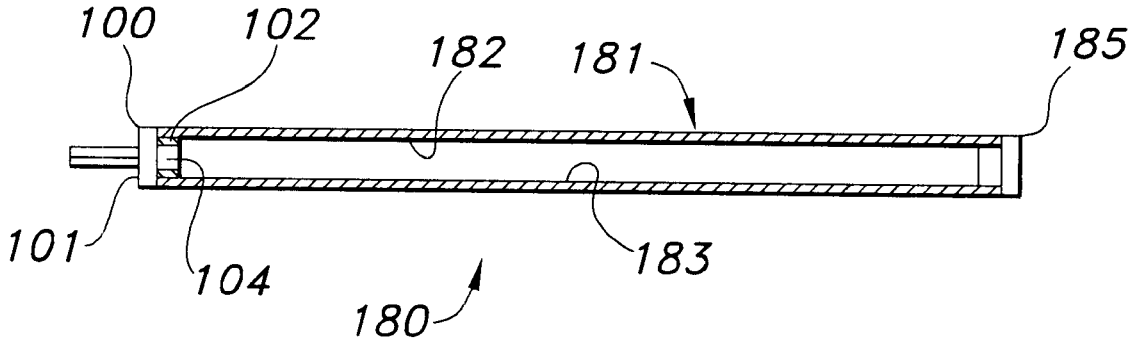
FIG. 16 is a sectional side view of a pressure actuated switching device including electrified and unelectrified end plugs.

Referring now to FIGS. 14 and 16, pressure actuated switch 180 can be of the same structure as pressure actuated switch 90 or pressure actuated switch 190. Body 181 is preferably a resiliently flexible thermoplastic plasticized polymer such as PVC or the like. Terminal plug 100 is inserted at one end of the pressure actuated switch 180. Upper and lower metal contacts 103 and 104 contact upper and lower conductive films 182 and 183, respectively. Body 101 abuts the end of the pressure actuated switching device 180 to prevent debris or moisture from entering into the interior of the pressure actuated switching device 90. The opposite end of the pressure actuated switching device 90 is preferably also closed with a plain, non-electrical plug or by other suitable means as shown in FIG. 16.

Figure 17:
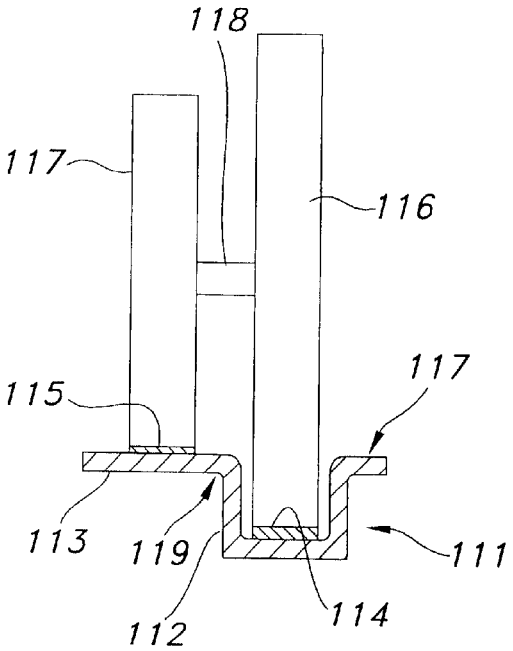
FIG. 17 is a diagrammatic view of an apparatus for coating a substrate.
Figure 18:
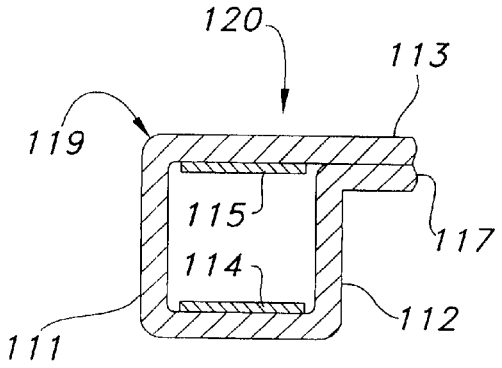
FIG. 18 is a sectional view of another embodiment of the pressure actuated switching device.

Referring to FIG. 17, another aspect of the invention is illustrated. A substrate is fabricated from a resiliently flexible thermoplastic elastomeric polymer such as plasticized PVC, or a thermoset elastomer such as natural or synthetic rubber and is extruded or otherwise formed into an elongated member 111 having a generally U-shaped portion 112 and lateral flaps 113 and 117. Conductive electrode liquid coatings 114 and 115 are linearly applied as conductive strips on the lateral surfaces of the U-shaped portion 112 and lateral flap 113 by rolls 116 and 117 respectively, as shown in FIG. 11. Optionally, conductive coating 114 can be of increased width as, for example, conductive electrode coating 192 as shown in FIG. 14, to promote greater side sensitivity to laterally applied force. Preferably, rolls 116 and 117 are independently rotatable on axle 118.

After the conductive electrode coatings 114 and 115 are dried or cured, flap 113 can be folded over at bend 119 and bonded to flap 117 by any suitable bonding method to form an elongated pressure actuated switching device similar to that illustrated in FIG. 9.

While the above description contains many specifics, these specifics should not be construed as limitations on the scope of the invention, but merely as exemplifications of preferred embodiments thereof. Those skilled in the art will envision many other possibilities within the scope and spirit of the invention as defined by the claims appended hereto.

What is claimed is:

1. A method for making a pressure actuated switching device comprising the steps of:

a) providing a first substrate having a first surface;

b) providing a transfer substrate having a release surface;

c) applying a first conductive film to the release surface of the transfer substrate;

d) contacting the first conductive film with the first surface of the first substrate under conditions of heat and pressure sufficient to cause the first conductive film to transfer from the release surface of the transfer sheet to the first surface of the first substrate; and e) positioning the first substrate in juxtaposition with a second substrate.

2. The method of claim 1 wherein the second substrate has a second surface with a second conductive film on the second surface, and wherein the step of positioning the first substrate in juxtaposition with the second substrate comprises positioning the first substrate and the second substrate such that the first conductive film of the first substrate and the second conductive film of the second substrate are in spaced apart opposing relation.

3. The method of claim 2 wherein the second conductive film of the second substrate is formed by transferring the second conductive film from a second transfer substrate to the second surface of the second substrate.

4. The method of claim 1 further including the step of providing a spacer element positioned between the first conductive film and the second conductive film.

5. The method of claim 1 wherein the first substrate is fabricated from a flexible and resilient polymer.

6. The method of claim 5 wherein the polymer includes polyvinyl chloride.

7. The method of claim 6 wherein the step of providing a first substrate includes providing a fluid unfused plastisol, and heating the plastisol to a temperature sufficient to fuse the plastisol.

8. The method of claim 7 wherein the first substrate has an exterior surface.

9. The method of claim 8 further including the step of embossing the exterior surface of the first substrate.

10. The method of claim 1 wherein the transfer substrate comprises a sheet of paper or fabric.

11. The method of claim 10 wherein the release surface is coated with a non-stick material selected from the group consisting of silicone and polytetrafluoroethylene.

12. The method of claim 1 wherein the step of applying a first conductive film includes applying a fluid conductive coating composition to the release surface of the transfer substrate by means of a process selected from the group consisting of casting, roller application, spraying, silk screening, rotogravure printing, knife coating, curtain coating and offset coating, and then drying the fluid conductive coating to form the conductive film.

13. The method of claim 12 wherein the conductive coating composition comprises a binder and a conductive filler and a liquid.

14. The method of claim 13 wherein the binder includes polyurethane.

15. The method of claim 14 wherein the conductive filler is a particulate comprising a material selected from the group consisting of silver, copper, gold, zinc, aluminum, nickel, silver coated copper, silver coated glass, silver coated aluminum, graphite powder, graphite fibers, and carbon.

16. The method of claim 13 wherein the liquid is selected from the group consisting of tetrahydrofuran, methylethyl ketone, diethyl ketone, acetone, butyl acetate, isopropanol, naphtha, toluene, xylene and water.

17. The method of claim 16 wherein the conducting film comprises a polymeric binder and a conductive filler including silver powder.

18. The method of claim 1 wherein the conductive coating has a thickness ranging from about 0.1 mils to about 60 mils.

19. The method of claim 1 wherein the conductive coating has a resistance ranging from about 0.001 to about 500 ohms per square.

20. The method of claim 7 wherein the unfused fluid plastisol is poured over the conductive film and release surface of the transfer substrate prior to being fused.

21. The method of claim 20 further including the step of embossing and cooling the fused plastisol.

22. The method of claim 20 wherein the transfer substrate is a sheet of paper.

23. The method of claim 20 wherein the transfer substrate is a fabric belt wherein the fused plastisol having the conductive film is separated from the fabric belt, the fabric belt being recycled to step (c) of applying the first conductive film.

24. The method of claim 2 wherein the pressure actuated switching device is formed into an elongated switch having two opposite end openings, wherein an electrical plug is inserted into one of said end openings, the electrical plug having a first electrical contact surface in electrical contact with the first conductive film, and a second electrical contact surface in electrical contact with the second conductive film, and first and second wires extending from said first and second electrical contact surfaces for connection to an electrical circuit.

25. The method of claim 2 further including the step of providing a standoff having a plurality of openings, and positioning the standoff between the first conductive film and the second conductive film.

26. The method of claim 25 further including the step of providing a piezoresistive material and positioning the piezoresistive material between the standoff and the first conductive film and/or the second conductive film.

27. A pressure actuated switching device made in accordance with the method of claim 1.

28. A pressure actuated switching device, which comprises:

a) a longitudinally extending base fabricated as a single layer from a single composition, said base having an upper surface, the upper surface having a central portion and at least one peripheral portion;

b) a first conductive electrode coating deposited on the central portion of the upper surface of said base but not on the peripheral portion;

c) an elastomeric longitudinally extending cover fabricated as a single layer from a single composition, said cover having an inner surface, the inner surface having a generally U-shaped portion and at least one laterally projecting flange portion, the flange portion of the inner surface of the cover being fixedly attached directly to the peripheral portion of the upper surface of the base to define a longitudinal seam;

d) a second conductive electrode coating deposited on the U-shaped portion of the inner surface of the cover but not on the flange portion.

29. The device of claim 28 wherein at least one of the first and second conductive electrode coatings is an elastomeric film having a thickness ranging from about 0.1 mils to about 60 mils.

30. The device of claim 28 wherein at least one of the first and second conductive electrode coatings comprises a conductive filler dispersed in an elastomeric matrix.

31. The device of claim 28 wherein the U-shaped portion of the inner surface of the cover comprises a curved upper portion and vertical side portions, and the second conductive electrode coating longitudinally extends along the inner surface of the cover at the curved upper portion.

32. The device of claim 31 wherein the second conductive electrode coating longitudinally also extends along the inner surface of the cover at the vertical side portions.

33. The device of claim 28 wherein the U-shaped portion of the inner surface of the cover comprises a flat, horizontal upper portion and vertical side portions, and the second conductive electrode coating longitudinally extends along the inner surface of the cover at the flat, horizontal upper portion.

34. The device of claim 33 wherein the second conductive electrode coating longitudinally also extends along the inner surface of the cover at the vertical side portions.

35. The device of claim 28 wherein both the base and the cover are fabricated from a single sheet of elastomeric material and connected to each other along a longitudinal fold line defining an edge of the pressure actuated switching device.

36. The device of claim 28 further including a terminal plug attached at an end of the device.

37. The device of claim 36 wherein the terminal plug includes first and second electrical contacts movable between a first position wherein the first and secoiid electrical contacts are relatively further from each other and a second position wherein the first and second electrical contacts are relatively closer to each other, the first and second electrical contacts being resiliently biased to the first position by a resilient member.

38. The device of claim 37 wherein the first and second electrical contacts each include a conductive member for contacting a respective one of the first and second conductive electrode coatings, and the terminal plug further includes first and second lead wires attached, respectively to the conductive members of the first and second electrical contacts.

39. The device of claim 38 wherein the conductive members of the terminal plug are strips of metal foil.

40. The device of claim 37 wherein the resilient member is selected from the group consisting of a spring or resilient polymeric foam.

* * * * *